United States Patent [19]

Strangfeld

[11] Patent Number: 4,571,753

[45] Date of Patent: Feb. 25, 1986

[54] TOILET-TANK DISCHARGE VALVE

[75] Inventor: Reiner Strangfeld, Bückeburg/BRD, Fed. Rep. of Germany

[73] Assignee: Georg Rost & Sohne Armaturenfabrik GmbH & Co Kg, Porta Westfalica-Lerbeck, Fed. Rep. of Germany

[21] Appl. No.: 531,810

[22] Filed: Sep. 13, 1983

[30] Foreign Application Priority Data

Sep. 15, 1982 [EP] European Pat. Off. ..... 82108502.4

[51] Int. Cl.[4] ..... E03D 1/14; E03D 3/12

[52] U.S. Cl. ..... 4/324; 4/378; 4/410; 4/413; 4/415; 4/381; 4/387

[58] Field of Search ..... 4/324, 325, 378, 392, 4/393, 395, 405, 411–415, 379, 381, 387, 410

[56] References Cited

U.S. PATENT DOCUMENTS

| | | | |
|---|---|---|---|
| 2,685,694 | 8/1954 | Allison | 4/324 |
| 2,809,378 | 10/1957 | Newton, Jr. | 4/324 |
| 3,067,432 | 12/1962 | New | 4/324 |
| 3,775,778 | 12/1973 | Lee | 4/325 |

*Primary Examiner*—Stephen Marcus

*Assistant Examiner*—Linda J. Sholl

*Attorney, Agent, or Firm*—Sprung, Horn, Kramer & Woods

[57] ABSTRACT

The valve piece of a toilet-tank discharge valve is moved into its open position by the release activation of an associated activating mechanism. It usually remains in this position until the flushing process is complete and the drops back into the closed position. The valve piece can also be moved back into its closed position ahead of time by discontinuance activation. The activating mechanism has a shift mechanism that can be reversed in its operating direction by a change of state in the toilet tank associated with release activation in such a way that discontinuance activation can result from renewed activation of one and the same activating mechanism in the same direction as during release activation. The device is convenient to operate and provides a wide range of possible ways of designing the operating element from the aspect of appearance. Simple remote operating devices can also be employed. The shift mechanism can also be shifted back in accordance with the further change of state in the tank resulting from discontinuance activation and from regular closure.

12 Claims, 6 Drawing Figures

TOILET-TANK DISCHARGE VALVE

BACKGROUND OF THE INVENTION

The present invention relates to a toilet-tank discharge valve with a valve piece that is displaced into an open position by release activation of an associated activating mechanism, remains in that position until completion of the flushing process, and then returns to the closed position, it being possible to displace the valve piece back into the closed position ahead of time by discontinuation activation of the activating mechanism.

In a known discharge valve of this type, the flushing process can be discontinued ahead of time by activating the operating element in a direction opposite that of the release motion. Although this design is very simple, if the operating element is not a rocker button, it must be activated in the opposite direction, which is not very convenient. The operating element must also have an appropriate grasping potential, which is not always easy to attain in toilet tanks in which the activating button is, for appearance for example, mounted flush with the surface in the middle of the cover. One essential drawback to available two-way discontinuation activation is that conventional remote activation, which usually has only one effective direction available, can not be employed.

SUMMARY OF THE INVENTION

The object of the present invention is to accordingly provide a toilet-tank discharge valve of the overall generic type that is simple in design and in which the flushing process can be discontinued by activating the operating element a second time in the same direction that is used for release activation.

This objective is achieved in accordance with the invention wherein the activating mechanism has a shift mechanism the operating direction of which can be reversed in accordance with a change of state in the toilet tank associated with release activation and can be shifted back again in accordance with the further change of state in the toilet tank resulting from discontinuance activation and from regular closing.

The direction in which the transmission mechanism between the operating element and the valve piece will take effect is accordingly predetermined by the state in which the toilet tank happens to be whenever it is activated. If the toilet tank is full, the discharge valve will open when the device is activated (release activation). A second and parallel activation during the flushing process will on the other hand close the discharge valve ahead of time (discontinuation activation).

If no discontinuation activation occurs, the discharge valve will automatically close after discharging the full amount of water necessary for flushing, and the recharging process will accordingly be initiated later. In both cases, however, subsequent activation will reinitiate the flushing process, although not if necessary until the water level is high enough.

A toilet-tank discharge valve of this type is very easy to use. It provides a wide range of potential for the design of the operating element from the aspect of appearance and a pushbutton, for example, can be used which can be flush with the surface of and in the middle of the toilet-tank cover. Simple remote devices can also be employed.

Further preferred embodiments of a toilet-tank discharge valve of this type are described wherein examples of simply designed shift mechanisms are disclosed that correspond to various changes of state in the toilet tank as the result of the valve opening and closing. Possible control parameters include flushing-water flow rate, the height of the water level, the behavior of the tank-charging valve, and the momentary position of the discharge valve itself.

Some embodiments of the invention will now be described with reference to the drawings, which are schematic and in which

DETAILED DESCRIPTION OF THE INVENTION

Figure 1:
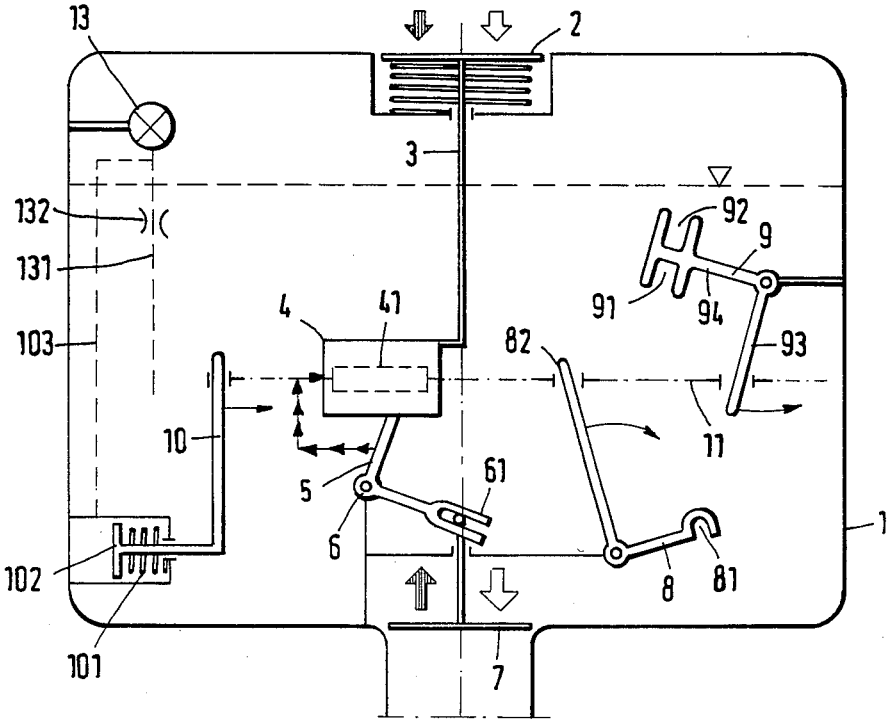
FIG. 1 illustrates a toilet-tank discharge valve according to the present invention with a mechanical activating element in combination with various shift mechanisms.

FIG. 1 illustrates a toilet tank 1 that is full of water and ready to flush. A pushbutton 2 at the top is connected by rod 3 to a shift-mechanism housing 4, which moves as a result of release activation (black arrow, top) relative to the vertical shift-mechanism arm 5 of a angled lever 6 pivoting it to the left. The forked arm 61 of angled lever 6 simultaneously opens a coupled-on valve piece 7, initiating the flushing process. Mechanisms (floats, catches, etc.) that are not illustrated conventionally ensure that valve piece 7 remains open subsequent to the return stroke of push button 2, in other words until the completion of release activation.

If activation is renewed during the rinsing process (discontinuation activation, white arrow, top), the motion of shift-mechanism housing 4 relative to shift-mechanism arm 5, which is now on the left, will be repeated. It will, however, now be pivoted to the right, closing coupled-on valve piece 7 (white arrow, bottom).

Control members 8, 9, and 10 establish the direction in which shift-mechanism housing 4 operates. These members assume different positions depending on the operating state of the toilet tank and transmit them through coupling rod 11 to a shift-mechanism piece 41 inside housing 4.

Control member 8 responds to the current of flushing water. It is therefore a pivoting angled lever. The lift of a float compartment 81 on the horizontal arm establishes the initial position, illustrated. In this position the vertical arm 82 that engages coupling rod 11 defines the left-hand position. A flow of water is initiated as the result of release activation, overcomes the lift of float compartment 81, and pivots the angled lever 8 in the direction indicated by the arrow, simultaneously shifting coupling rod 11 into its right-hand position.

Control member 9 responds to the level of water in the tank. This component is also a pivoting angled lever, with a vertical arm 93 that acts on coupling rod 11. A float compartment 91 with a lift that establishes the initial position, illustrated, is mounted on its horizontal arm 94. The water level sinks subsequent to release activation. The lift will disappear and the weight of water compartment 92 will pivot control member 9 in the direction of the arrow parallel to coupling rod 11.

Control member 10 responds to the outflow from charging valve 13. In the inactive state compression spring 101 establishes the left-hand position of piston 102 and hence of coupling rod 11. The water level drops as the result of release activation, opening charging valve 13. A choke 132 in charging line 131 builds up pressure in control line 103. Piston 102 shifts control member 10 and, with it, coupling rod 11 to the right.

Figure 2:
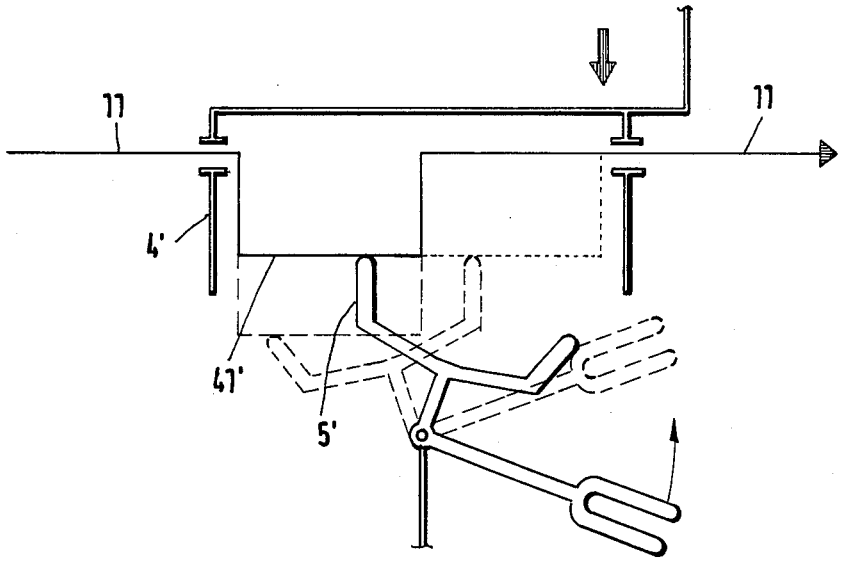
FIG. 2 is a mechanical shift mechanism according to the present invention for some of the control members illustrated in FIG. 1, FIGS. 3 and 4 show a mechanical shift mechanism according to the present invention for the toilet-tank discharge valve illustrated in FIG. 1.

FIG. 2 is a larger-scale view of a shift-mechanism housing 4'. A shift-mechanism piece 41' that is connected to coupling rod 11 is accommodated horizontally in the housing. The initial position of shift-mechanism piece 41' and of the forked shift-mechanism arm 5' that operates in conjunction with it is represented by the continuous lines. Release activation (arrow, top) result in the shift position represented by the dashed lines, and the flushing process is initiated.

This initiates the aforementioned changes in state in the tank, and one of the control members 8, 9, or 10 shifts shift-mechanism piece 41' into its right-hand position, represented by the dotted lines. In this state, renewed activation will pivot shift-mechanism arm 5' from the position represented by the dashed lines into the initial position, discontinuing the flushing process. In the absence of discontinuation activation valve piece 7 will close automatically, the tank will fill up again, and all component will assume their initial position again.

Another and very practical control parameter for the direction in which shift-mechanism housing 4 operates is the position of valve piece 7. This mechanical change of state can be directly coupled back from shift-mechanism arm 5 to shift-mechanism housing 4 as symbolized in FIG. 1 by the line of arrows.

Figure 3:
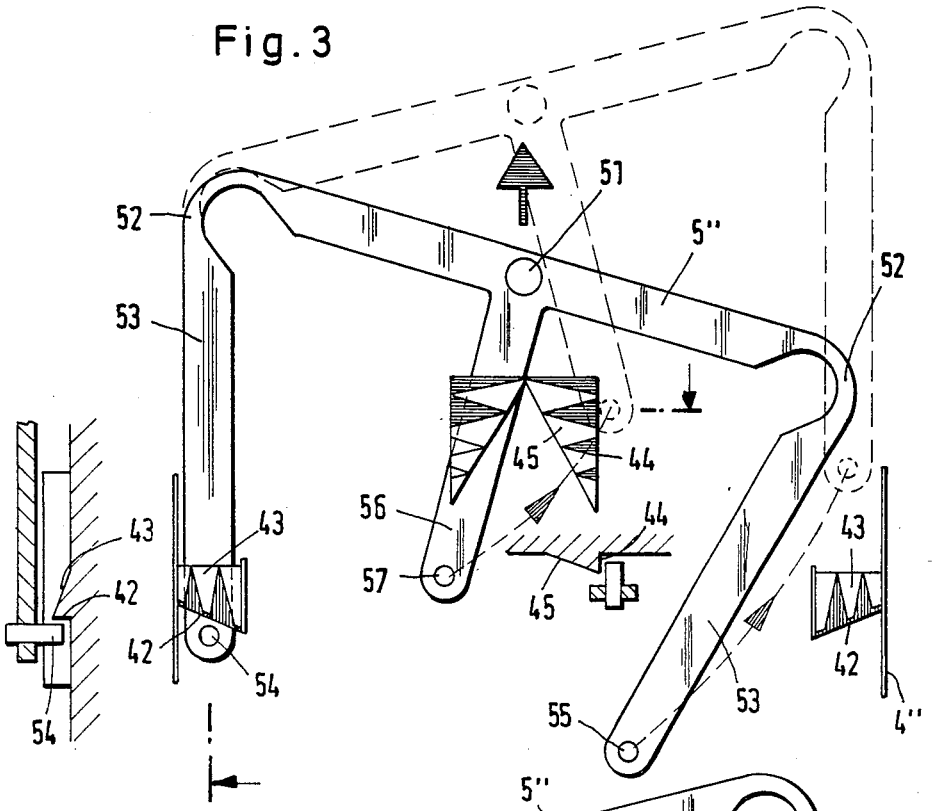
Figure 4:
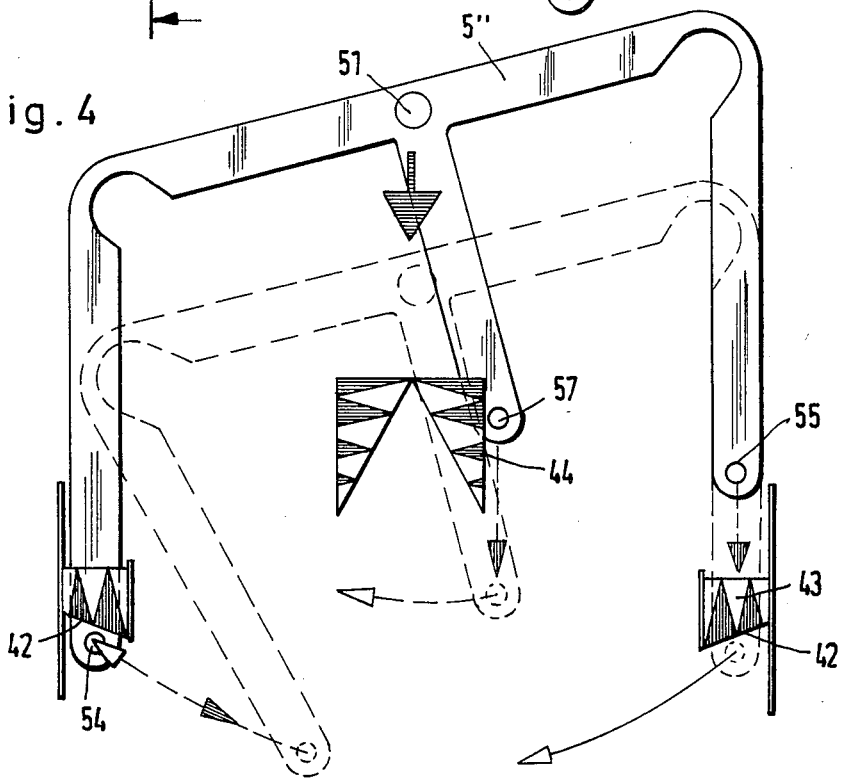

One potential embodiment is illustrated in FIGS. 3 and 4. To make the figure more comprehensible the control contours of the symmetrical shift-mechanism housing 4'', represented in heavy lines, is illustrated as stationary in contrast to FIG. 1. The relative motion that occurs with every activation is accordingly initiated by a mounting pivot 51 on shift-mechanism arm 5'', which is also symmetrical. The continuous lines in FIG. 3 represent the initial position. Lever arms 53 are attached to each end at flexible connecting sections 52. At the bottom of lever arms 53 are a left-hand control pin 54 and a right-hand control pin 55, which operate in conjunction with stationary catches 42 and their access flanks 43. The intermediate arm 56 has a control pin 57 at the top that operates in conjunction with stationary catches 44 and their access flanks 45. Since the arms that have the control pins are all flexible perpendicular to the plane of projection, the access flanks do not represent impediments.

When mounting pivot 51 moves up in the direction indicated by the arrow (corresponding to the relative motion between the shift-mechanism housing 4 and shift-mechanism arm 5 in FIG. 1) during activation, shift-mechanism arm 5'' will pivot on its left-hand flexible connection section because the upward motion will be impeded at this point by the left-hand control pin 54 that engages the rear of catch 42. On its way into the limiting position represented by the dashed lines, the control pin 57 on intermediate arm 56 will slip over the access flank 45 of catch 44 and come to rest behind it.

This limiting position is the initial position, represented in FIG. 4 by the continuous line, for the subsequent activation return stroke (backward relative motion of mounting pivot 51, arrow). Control pin 57 simultaneously slips down behind its catch 44, locking shift-mechanism arm 5'' into its limiting position. Left-hand control pin 54 releases from its catch 42 and springs back into its original position relative to shift-mechanism arm 5''. In the final phase of the return stroke, right-hand control pin 55 slips over access flank 43, the upper left edge of which secures the pivoting position, before control pin 57 leaves its catch 44. The limiting position of the return stroke is represented by the dashed lines. Right-hand control pin 55 is locked behind catch 42.

In the altered initial position a renewed double stroke, discontinuation activation in other words, will result because of the symmetrical design of the shift mechanism just described in the opposite sequence of motions, shift-mechanism arm 5'' pivoting back into its original position.

The control pins will not be impeded in the unactivated state by the stationary control contours. Shift-mechanism arm 5'' can therefore be pivoted back into its original initial position by very slight exterior forces, which must only be powerful enough to overcome the friction of mounting pivot 51. This is represented by the white arrows in FIG. 4. The closure motion of the valve piece 7 coupled to shift-mechanism arm 5'' will not be impeded when the total contents of the tank have flowed out.

Figure 5:
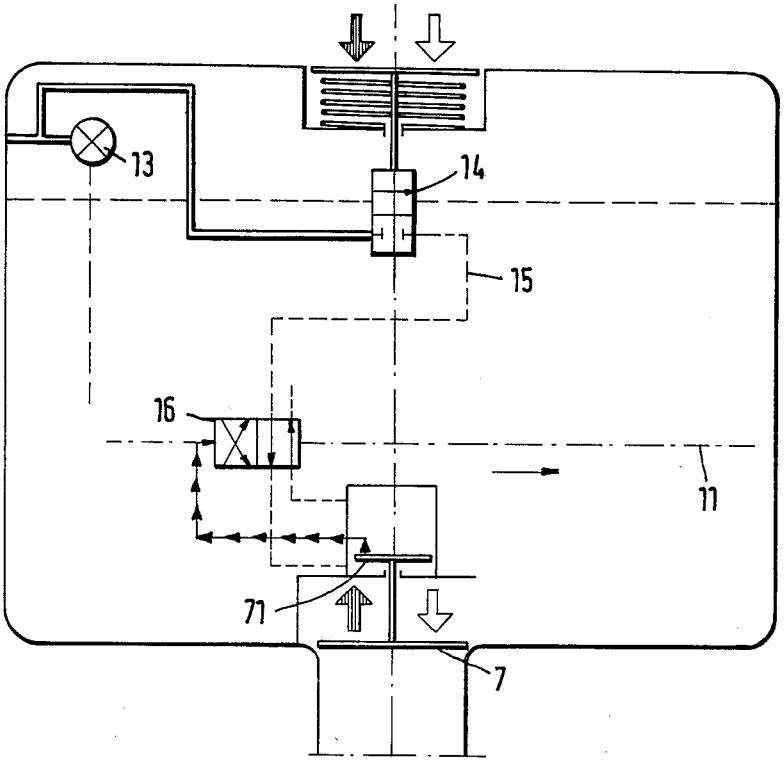
FIG. 5 is a toilet-tank discharge valve with a hydraulic activating element according to the present invention.

The principles of function previously described are not restricted to mechanical activation. A hydraulically activated discharge valve is illustrated in FIG. 5 as one example of the overall range of application. When this device is activated (black arrow, top), activating valve 14 opens. The line pressure upstream of charging valve 13 arrives through control line 15 and shift-mechanism valve 16 below piston 71 and the coupled-on valve piece 7 opens. Alternatively, all the control members illustrated in FIG. 5 can be shifted to the right over the coupling rod 11 on shift-mechanism valve 16. Discontinuance activation during the flushing process (white arrow, top) will then apply pressure from above to piston 71 and valve piece 7 will close (white arrow, bottom).

The line of arrows represents the additional potential of directly predetermining the direction in which shift-mechanism valve 16 operates by the position of valve piece 7.

Figure 6:
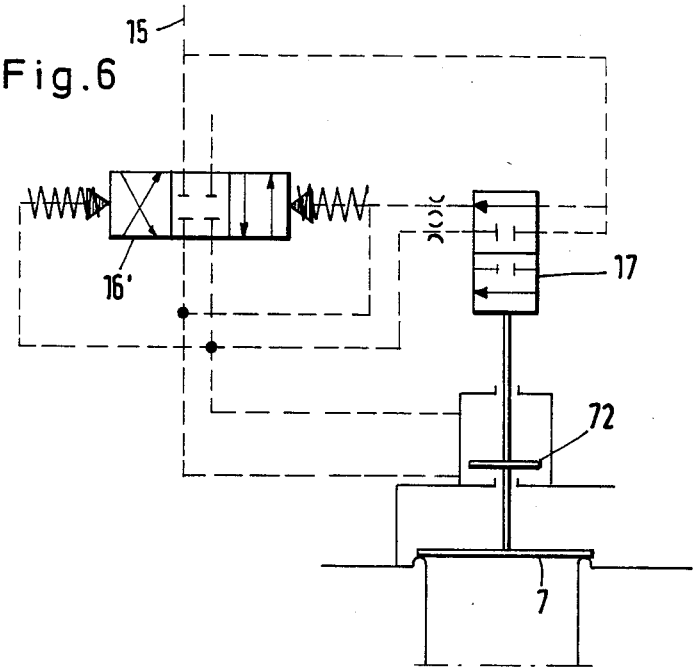
FIG. 6 is a hydraulic shift mechanism according to the present invention, for the toilet-tank discharge valve illustrated in FIG. 5.

FIG. 6 represent one embodiment as an example. Control line 15 leads from an activating valve 14, not illustrated, to both a shift-mechanism valve 16' and a preliminary-control valve 17 that is coupled to valve piece 7.

Upon release activation the pressure pulse travels through preliminary-control valve 17 to the right face of shift-mechanism valve 16' and forces it to the left. This position is self-maintaining and accordingly independent of the further motion of preliminary-control valve 17. The pressure on the bottom of piston 72 is accordingly not interrupted in the opening phase of the discharge valve.

Subsequent to release activation shift-mechanism valve 16 is resiliently restored back to its neutral intermediate position.

Upon discontinuance activation, the pressure pulse shifts shift-mechanism valve 16' to the right, where it maintains itself, as the result of the changed position of preliminary-control valve 17, and piston 72 will shift valve piece 7 in the closure direction. The initial state will accordingly be attained again. This is also the case in the absence of discontinuance activation when valve piece 7 closes automatically once the full amount of rinsing water has run out. Preliminary-control valve 17 must therefore be kept free of friction so that this motion will not be impeded.

Obviously, the examples described represent only a fraction of the wide range of possible embodiments of the theory behind the invention.

It will be appreciated that the instant specification and claims are set forth by way of illustration and not limitation, and that various modifications and changes may be made without departing from the spirit and scope of the present invention.

What is claimed is:

1. In a toilet-tank discharge valve having a valve piece that is shiftable into an open position in response to the release activation of an associated activating mechanism and which maintains itself in that position until the flushing process is completed, and then drops into a closed position, and wherein the valve piece is movable back into the closed position before completion of the flushing process by a discontinuance activation of the activating mechanism, the improvement wherein the activating mechanism comprises an activating element identically actuatable to effect release activation and discontinuance activation and a shift mechanism reversably shiftable in opposite operating directions to open and close the valve piece in response to actuation of the activating element to effect a change of state in a toilet tank due to desired release activation and to a change of state in the toilet tank due to discontinuance activation and in response to the normal closing of the valve piece upon completion of the flushing process.

2. The toilet-tank discharge valve as in claim 1, wherein the shift mechanism includes shift means for directly controlling the valve piece and a first control member operatively connected to the shift means and movable in response to the flow of flushing water occurs subsequent to release activation.

3. The toilet-tank discharge valve as in claim 2, wherein the shaft mechanism includes a second control member operatively connected to the shift means and movable in response to a drop in the water level inside the tank.

4. The toilet-tank discharge valve as in claim 3, wherein the control members comprise pivoting angled levers each with one arm that supported a float compartment that shifts back when the tank fills up.

5. The toilet-tank discharge valve as in claim 4, wherein the arm of the second control member has a water compartment at the top.

6. The toilet-tank discharge valve as in claim 3, wherein the shift mechanism includes a third control member operatively connected to the shift means and movable by a charging valve against the force of a resetting spring when the water level drops.

7. The toilet-tank discharge valve as in claim 6, wherein the shift mechanism further comprises a housing and wherein the shift means comprises a shift-mechanism piece in the housing and flexibly coupled to the control member and a shift-mechanism arm coupled to the valve piece and receptive of a force from the shift mechanism piece to dispose same in one of two shift positions.

8. The toilet-tank discharge valve as in claim 7, wherein the shift mechanism arm is a fork with two ends and wherein shift-mechanism piece is mounted to slide transversely in the shift-mechanism housing and cooperates with one end or the other of the forked shift-mechanism arm depending on the shift position thereof.

9. The toilet-tank discharge valve as in claim 1, wherein the shift mechanism includes an arm movable between two positions and means coupling the arm to the valve piece such that the direction in which the shift mechanism operates is defined by the position of the valve piece and thereby the shift-mechanism arm coupled to it which follows the motions of the valve piece when the arm is in the unactivated state.

10. The toilet-tank discharge valve as in claim 1, wherein the shift mechanism comprises a hydraulic activating mechanism having a piston operatively connected to the valve piece and a shift-mechanism valve, the position of which predetermined the upward or downward motion of the piston and thereby of the valve piece.

11. The toilet-tank discharge valve as in claim 6, wherein the shift mechanism further comprises a hydraulic activating mechanism having a piston operatively connected to the valve piece and a shift-mechanism valve, the position of which predetermines the upward or downward motion of the piston and thereby of the valve piece and wherein the shift-mechanism valve is operatively connected to one of the control members.

12. The toilet-tank discharge valve as in claim 10, wherein the shift-mechanism valve comprises a three-position valve with its neutral intermediate position determined in the inactivated state by resetting springs and further comprising a preliminary-control valve coupled to the valve piece for following the motions of the valve piece in the inactivated state to determine the operating direction of the three position valve.

* * * * *